US005638094A

United States Patent [19]

Tang

[11] Patent Number: 5,638,094

[45] Date of Patent: Jun. 10, 1997

[54] METHOD AND APPARATUS FOR DISPLAYING MOTION VIDEO IMAGES

[75] Inventor: Alex Tang, Hsinchu, Taiwan

[73] Assignee: United Microelectronics Corp., Hsinchu, Taiwan

[21] Appl. No.: 333,149

[22] Filed: Nov. 1, 1994

[51] Int. Cl.[6] ..... G09G 5/00

[52] U.S. Cl. ..... 345/200; 345/199; 345/203

[58] Field of Search ..... 345/200, 203, 345/199, 122, 132, 133, 186

[56] References Cited

U.S. PATENT DOCUMENTS

| | | | |
|---|---|---|---|
| 4,116,444 | 9/1978 | Mayer et al. . | |
| 4,324,401 | 4/1982 | Stubben et al. . | |
| 4,435,779 | 3/1984 | Mayer et al. | 345/203 |
| 4,445,114 | 4/1984 | Stubben . | |
| 4,471,465 | 9/1984 | Mayer et al. . | |
| 4,498,079 | 2/1985 | Ghosh et al. | 345/203 |
| 4,635,048 | 1/1987 | Nishi et al. | 345/203 |
| 4,644,495 | 2/1987 | Crane . | |
| 4,824,106 | 4/1989 | Ueda et al. | 345/203 |
| 4,864,289 | 9/1989 | Nishi et al. | 345/122 |
| 4,905,168 | 2/1990 | McCarthy et al. | 345/122 |
| 4,930,074 | 5/1990 | McCarthy et al. | 345/200 |
| 4,951,038 | 8/1990 | Yamamura | 345/122 |
| 4,980,678 | 12/1990 | Zenda | 345/199 |
| 5,047,958 | 9/1991 | Comins et al. | 345/203 |
| 5,089,811 | 2/1992 | Leach | 345/199 |
| 5,125,671 | 6/1992 | Ueda et al. | 345/203 |
| 5,321,425 | 6/1994 | Chia et al. | 345/203 |
| 5,367,317 | 11/1994 | Hosotani | 345/200 |
| 5,475,402 | 12/1995 | Hijikata | 345/199 |
| 5,519,413 | 5/1996 | Thomas et al. | 345/200 |

*Primary Examiner*—Richard Hjerpe
*Assistant Examiner*—Kent Chang
*Attorney, Agent, or Firm*—Curtis, Morris & Safford, P.C.

[57] ABSTRACT

A motion video image displaying apparatus and method of displaying is disclosed for displaying multiple fonts of video images in non-DMA mode for television-game machines. The inventive apparatus includes a status controller for generating a number of timing control signals. The apparatus comprises a parameter address generator for producing a parameter address based on the timing control signals and information issued by a CPU of the game machine; a tab address generator for producing a tab address based on the timing control signals, and for producing an overflow signal for the status controller; a color code address generator for producing a color code address based on the timing control signals, information read according to the tab address, and video information. Three tri-state buffers are also included for buffering the address outputs of the parameter address generator, the tab address generator, and the color code address generator, respectively, the buffers are controlled by the status controller to selectively output one of their buffered addresses. A video memory for storing and outputting video information and parameters based on the addresses generated by the parameter address generator, the tab address generator, and the color code address generator is also included.

24 Claims, 12 Drawing Sheets

METHOD AND APPARATUS FOR DISPLAYING MOTION VIDEO IMAGES

BACKGROUND OF THE INVENTION

1. Field of the Invention

The present invention relates in general to method and apparatus for displaying video images. In particular, the present invention relates to method and apparatus for displaying multiple fonts of video images in non-DMA (direct memory access) mode. More particularly, the present invention relates to method and apparatus for displaying multiple fonts of video images for television-game machines in non-DMA mode. Technical Background Video images displayed by television-game machines are typically generated in two portions: a relatively static background image portion and an active subject image portion. The two portions are generated separately but are combined together to constitute a complete video image. They are generated separately due to their distinct characteristics. For example, the background image portion generally has a larger screen area, and therefore, it requires a larger data size than the subject image portion, but its pixels change less often as the video images advance. On the other hand, the subject image portion occupies a relatively smaller portion of the entire display screen, and thus, it requires less data. However, since the subject image portion displays the "subject" of a video story, it is generally characterized by a relatively larger video change which is reflected in the changes to the data of the displayed pixels.

In general, a conventional image display device processes the two portions of a video image in a time-shared manner. The background image portion is processed during scanning, and another processor in the device predicts the changes of the subject image portion that will appear in the up-coming scanning cycle. The color information of the predicted subject image portion is retrieved and stored in a register, which is then retrieved and combined with the color information of the background image portion at the time when the next scanning cycle commences. The combined color information is then supplied to a television interface circuit which generates television compatible display signals.

In such a conventional image display device, image pixel bit mapping schemes are employed for the subject image portion based on the efficiencies of image storage, retrieval and processing. An image pixel bit mapping scheme is considered efficient for the processing of the subject image portion of the video because of its smaller data size and more drastic data changes. However, when the subject image portion of the video becomes relatively large, in other words, the subject image portion occupies a relatively large portion of the display screen and therefore requires a larger image data size, such image pixel bit mapping scheme would require a larger and contiguous memory space allocation, which deteriorates the operating efficiency of the display memory and renders the memory management more difficult.

OBJECTS AND SUMMARY OF THE INVENTION

It is therefore an object of the present invention to provide an apparatus and method for displaying motion video images that avoids the above indicated drawbacks of the prior art image pixel bit mapping scheme.

The present invention achieves the above-identified object by providing a motion video image displaying apparatus and method of displaying multiple fonts of video images in non-DMA mode for television-game machines. In other words, the present invention provides a motion video image displaying apparatus and method which accesses color codes of video images in a unit of font (each font consists 8×8 pixels), the address of each font is represented by a tab array, so that the required memory space can be reduced and the memory management is easier. The inventive apparatus includes a status controller for generating a number of timing control signals. The apparatus comprises a parameter address generator for producing a parameter address based on the timing control signals and information issued by a controller (e.g., CPU) of the game machine; a tab address generator for producing a tab address based on the timing control signals and for producing an overflow signal for the status controller; a color code address generator for producing a color code address based on the timing control signals, information read according to the tab address, and video information. Three buffers (e.g., tri-state buffers) are also included for buffering the address outputs of the parameter address generator, the tab address generator, and the color code address generator, respectively. The buffers are controlled by the status controller to selectively output one of their buffered addresses. A video memory for storing and outputting video information and parameters based on the addresses generated by the parameter address generator, the tab address generator, and the color code address generator is also included.

BRIEF DESCRIPTION OF THE DRAWINGS

Other objects, features and advantages of the present invention will become apparent by way of the following detailed description of the preferred but non-limiting embodiment. The description is made with reference to the accompanying drawings, wherein.

In all the figures, like reference numerals represent the same or similar components of the flash memory cell utilized for the description of the present invention.

DETAILED DESCRIPTION OF THE PREFERRED EMBODIMENT

Figure 1:
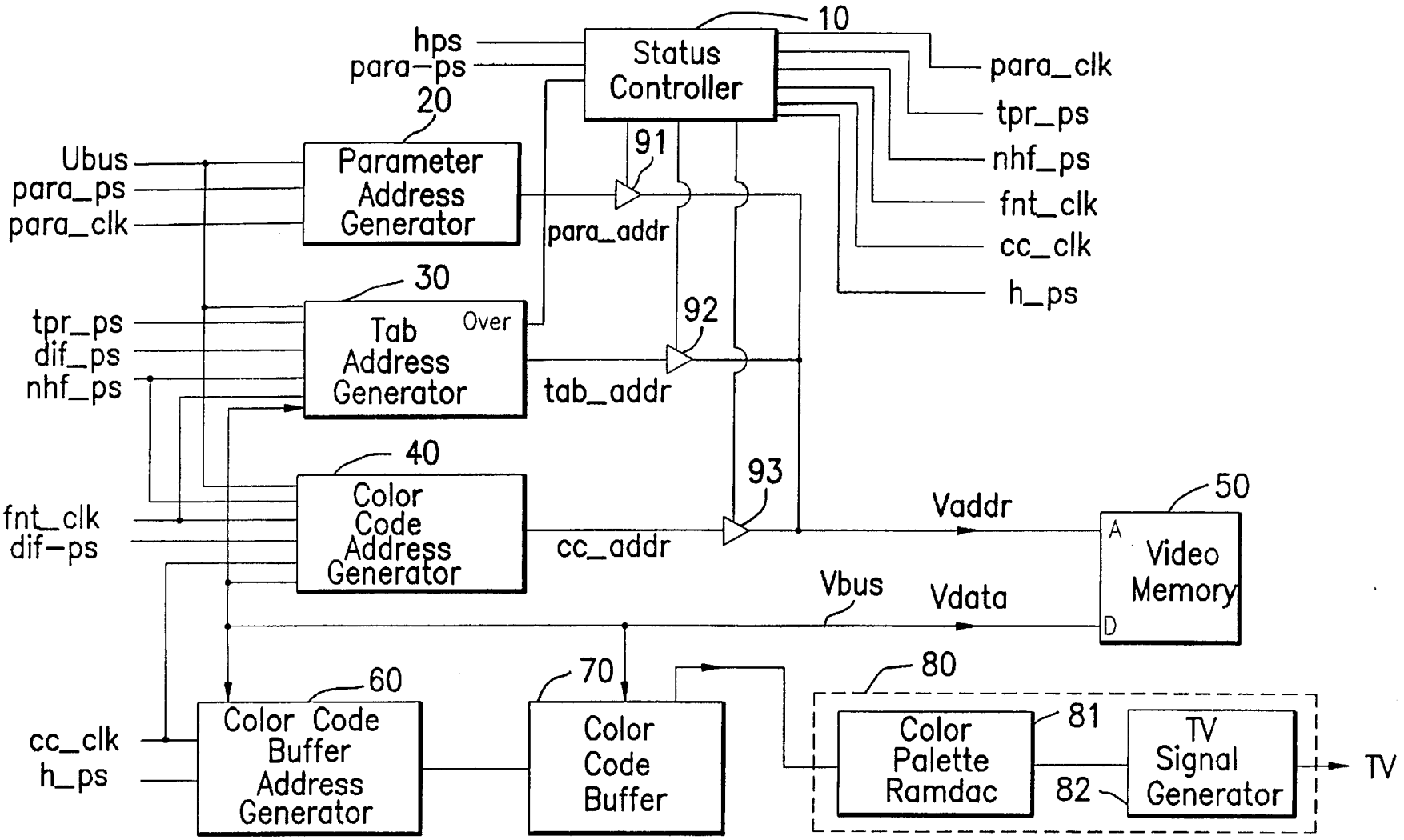
FIG. 1 is a block diagram of an apparatus for displaying motion video images in accordance with a preferred embodiment of the present invention.

Referring to FIG. 1, a block diagram of an apparatus for displaying motion video image in accordance with a preferred embodiment of the present invention is shown. The exemplified apparatus shown generally comprises a status controller 10, a parameter address generator 20, a tab address generator 30, a color code address generator 40, a video memory 50, a color code buffer address generator 60, a color code buffer 70, and a television interface 80. The apparatus generally shown in the block diagram of FIG. 1, for the purpose of displaying motion video images in accordance with the preferred embodiment of the present invention, is utilized to generate a standard television video signal at the television interface 80 by receiving various input signals at the other functional blocks of the apparatus generally enumerated above, which input signals are generated by other relevant functional devices in a television-game machine. Those other relevant functional portions are not shown in the drawing of the present invention which should be familiar to persons skilled in this art.

As shown in FIG. 1, the status controller 10 receives a horizontal-scan position signal hps as well as a parameter writing signal para-ps and generates a set of timing signals for controlling purposes. The generated controlling timing signals include, for example, parameter clock signal para_clk, tab-parameter writing signal tpr_ps, horizontal font number writing signal nhf_ps, font clock signal fnt_clk, color code clock signal cc_clk, and horizontal position writing signal h_ps. These timing signals are utilized by other constituent components of the apparatus as input for controlling their respective operation.

The parameter address generator 20 generates a parameter address para_addr by organizing two of the controlling timing signals, namely the parameter writing signal para_ps and the parameter clock signal para_clk, generated by the status controller 10, as well as the information issued by the CPU (not shown) of the system over the bus Ubus.

The tab address generator 30 generates a tab address tab_addr by organizing three of the controlling timing signals, namely the tab-parameter writing signal tpr_ps, the font clock signal fnt_clk, and the horizontal font number writing signal nhf_ps, generated by the status controller 10, as well as the information issued by the CPU of the system over the bus Ubus, and an additional difference writing signal dif_ps, as issued by the CPU of the television-game machine system. A set of video data Vdata sent by the video memory 50 is also utilized in the generation of the tab address tab_addr.

The color code address generator 40 generates a color code address cc_addr by organizing three of the controlling timing signals, namely the horizontal font number writing signal nhf_ps, the font clock signal fnt_clk, and the color code clock signal cc_clk, generated by the status controller 10, as well as the information issued by the CPU of the system over the bus Ubus, and the additional difference writing signal dif_ps. The set of video data Vdata sent by the video memory 50 over the video memory data bus Vbus is also utilized in the generation of the color code address cc_addr.

Each of the generated address signals, namely the parameter address para_addr from parameter address generator 20, the tab address tab_addr from tab address generator 30, and the color code address cc_addr from color code address generator 40, is buffered by tri-state buffers 91, 92 and 93, respectively. The outputs of the three tri-state buffers are connected to a common address bus, which feeds the address input signals Vaddr, to the video memory 50. The address signals Vaddr that appear on this address bus can thus strobe the address inputs of the video memory 50 under control of the status controller 10. It is noted that the three tri-state buffers may be replaced by a multiplexer for the same function.

The video memory 50 is utilized to supply data stored therein to, among others, the tab address generator 30 and the color code address generator 40 under the direction of the status controller 10. Notice, however, that the data Vdata retrieved from the video memory 50 over the bus Vbus, which is supplied to the tab and color code address generators 30 and 40, also plays the role of defining the address for accessing itself.

The color code buffer address generator 60 generates an address output signal that is supplied to the input of the color code buffer 70. This buffer address is generated based on the color code clock signal cc_clk and the horizontal position writing signal h_ps, as generated by the status controller 10, as well as the video data Vdata retrieved from data bus Vbus of the video memory 50.

The color code buffer 70 buffers the video data Vdata sent over the data bus Vbus at the address specified by the color code buffer address generator 60. This video data Vdata will be buffered and subsequently be sent out for display on the screen of the television-game machine.

The television interface 80 accepts the video data buffered by the color code buffer 70 as an input and transforms the video image information represented as color code into the television signal for display on the television screen. Television interface 80 may comprise of a color palette RAMDAC 81 and a television signal generator 82. The color palette RAMDAC 81 converts the digital color code into analog signals which are supplied to television signal generator 82 which transforms the analog signals into the television format, e.g., NTSC, PAL, or other format acceptable for display on the television screen attached to the television-game machine.

Figure 2:
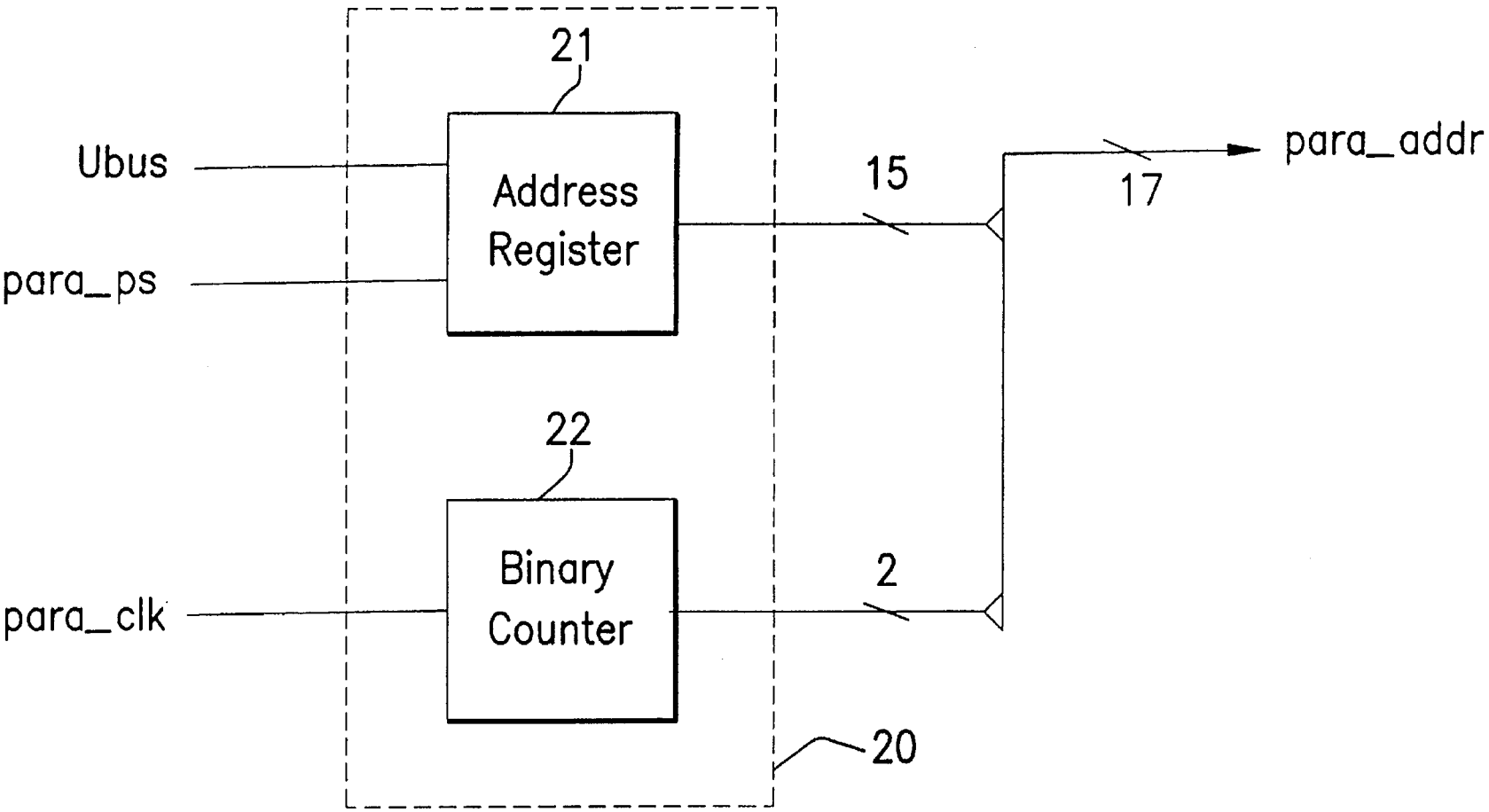
FIG. 2 is a block diagram of a parameter address generator employed in the motion video image displaying apparatus of FIG. 1.

Referring next to FIG. 2, a block diagram of the parameter address generator 20 employed in the motion video image displaying apparatus of FIG. 1 is shown. The parameter address generator 20 consists of an address register 21 and a binary counter 22. The address register 21 is utilized for storing the address information supplied on the Ubus under the control of the parameter writing signal para_ps as issued by the status controller 10 of FIG. 1. The binary counter 22, on the other hand, is controlled by the parameter clock signal para_clk which is also issued by the status controller 10, for maintaining a count, which is combined with the value stored in the address register 21 to generate the parameter address para_addr. The address register 21 can buffer, for example, a 15-bit address, which when combined with the 2-bit counting value, generates a 17-bit address, the parameter address, para_addr.

Figure 3A:
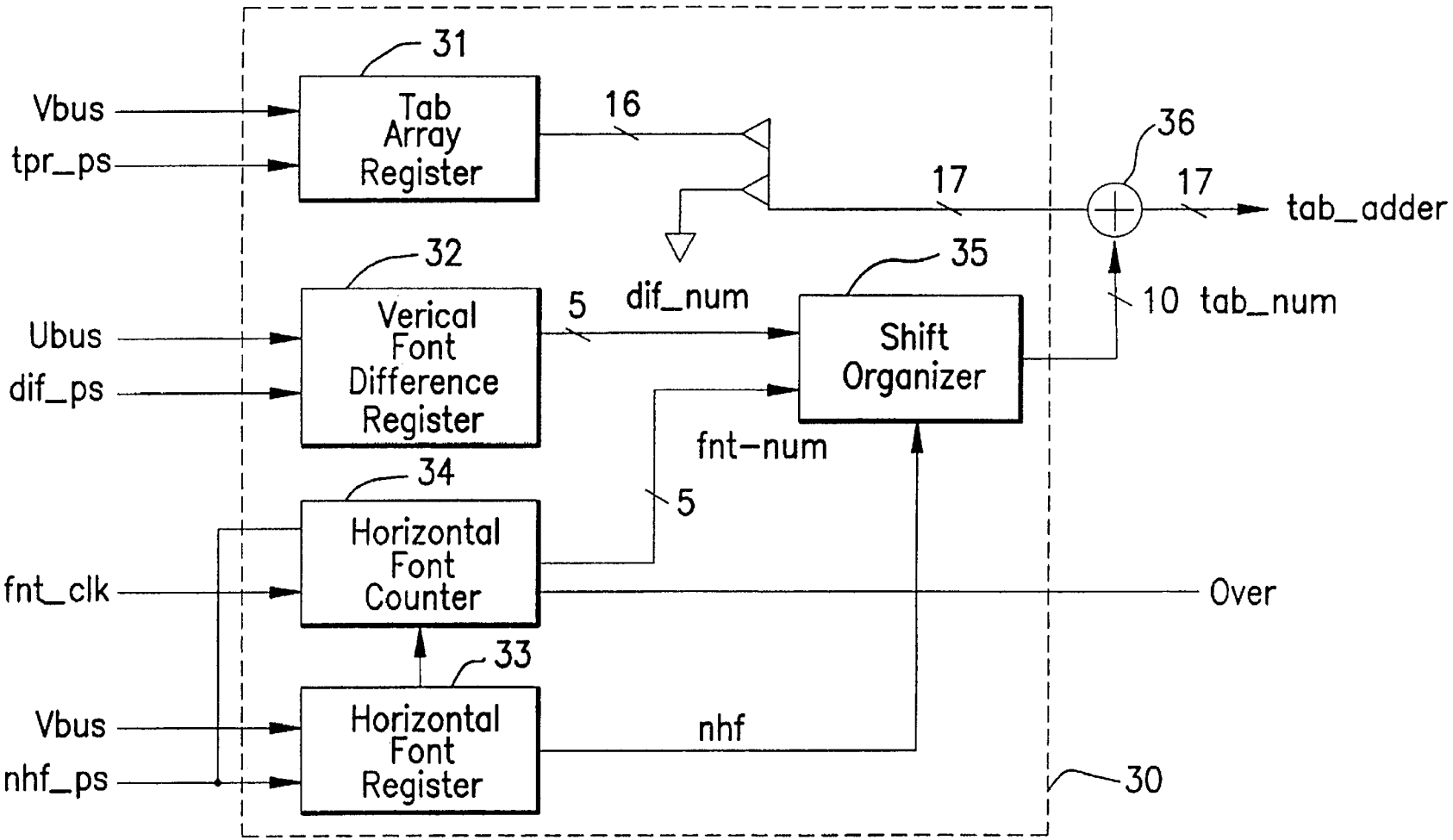
FIG. 3*a* is a block diagram of a font tab address generator employed in the motion video image displaying apparatus of FIG. 1.

Reference is now made to FIG. 3*a*, in which the tab address generator 30 employed in the apparatus of FIG. 1 is shown to comprise a tab array register 31, a vertical font difference register 32, a horizontal font register 33, a horizontal font counter 34, and a shift organizer 35. The tab array register 31 is utilized to hold the tab array address supplied by the data bus Vbus under the control of the tab parameter writing signal tpr_ps as issued by the status controller 10. The vertical font difference register 32 is employed to hold the information representing the font difference which is supplied by the bus Ubus under the control of the difference writing signal dif_ps issued by the CPU of the system. The horizontal font register 33 is utilized to hold the horizontal font information supplied by the data bus Vbus under the control of the horizontal font number writing signal nhf-ps issued by the status controller 10. The horizontal font counter 34 is utilized to maintain a count (fnt-num) of the horizontal font number, with its counting triggered by the same signal nhf_ps used for strobing the horizontal font register 33. The counter 34 generates an overflow signal "over" when its accumulated counter value of the font number exceeds the displayed range for the video image. The horizontal font number writing signal nhf_ps also resets the counter 34 each time a renewed sequence of writing commences.

Figure 3B:
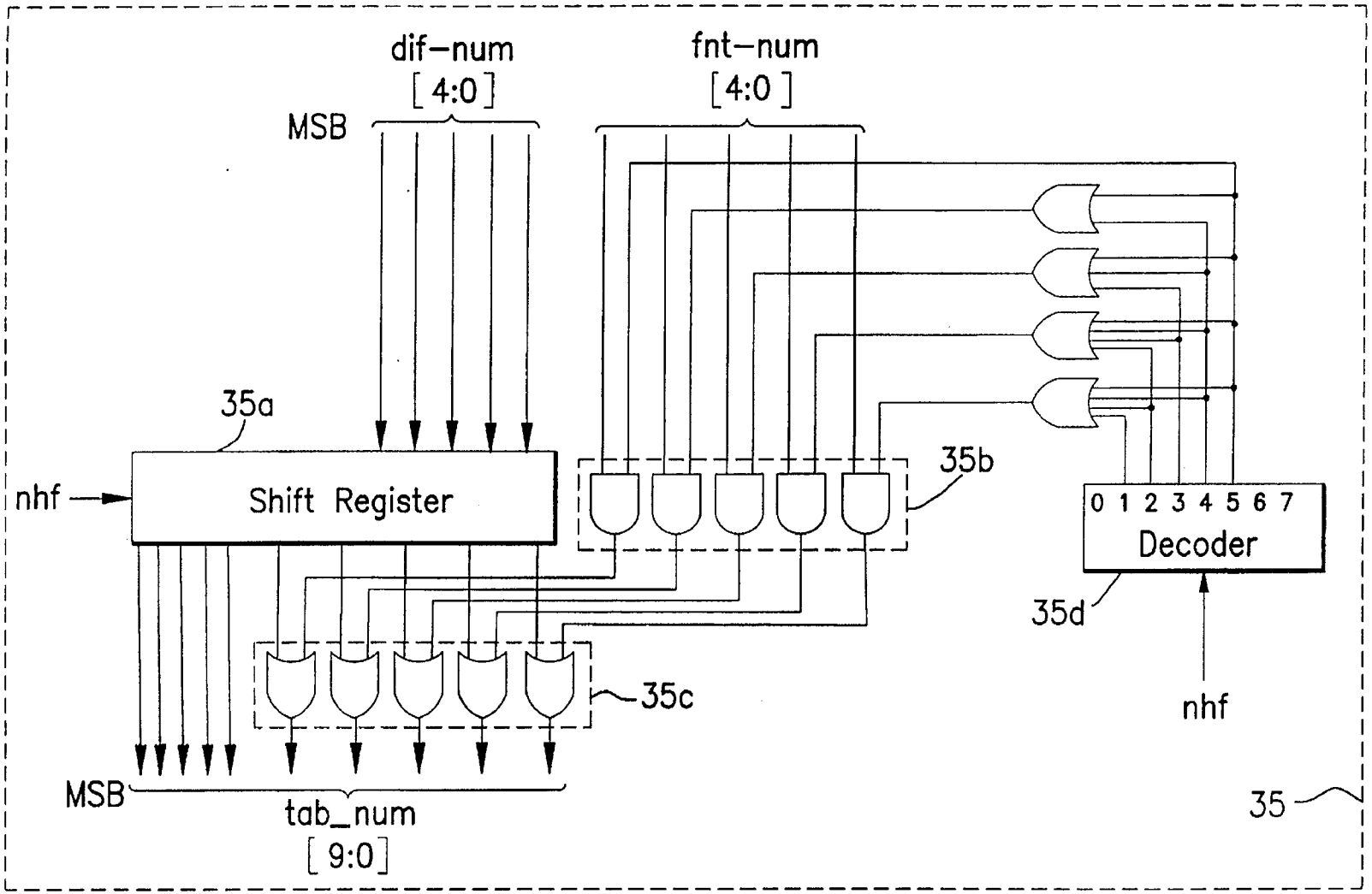
FIG. 3*b* is a schematic diagram of a shift organizer employed in the font tab address generator of FIG. 3*a;*

The shift organizer 35 is shown in FIG. 3*b* and comprises a shift register 35*a* which is utilized to apply shift processing to the font difference number dif_num stored in the vertical font difference register 32. The shifting is based on the horizontal font number nhf stored in the horizontal font register 33. The organizer 35 combines the font difference number dif_num and the count of the horizontal font number (fnt-num), both in this described example are 5-bit numbers, into a 10-bit tab number tab_num for output to one input of an adder 36. The operation of the shift organizer 35 is further described below. Adder 36, taking the other input supplied by the tab array register 31, outputs the added result as the generated tab address tab_addr shown in FIG. 1.

Figure 4:
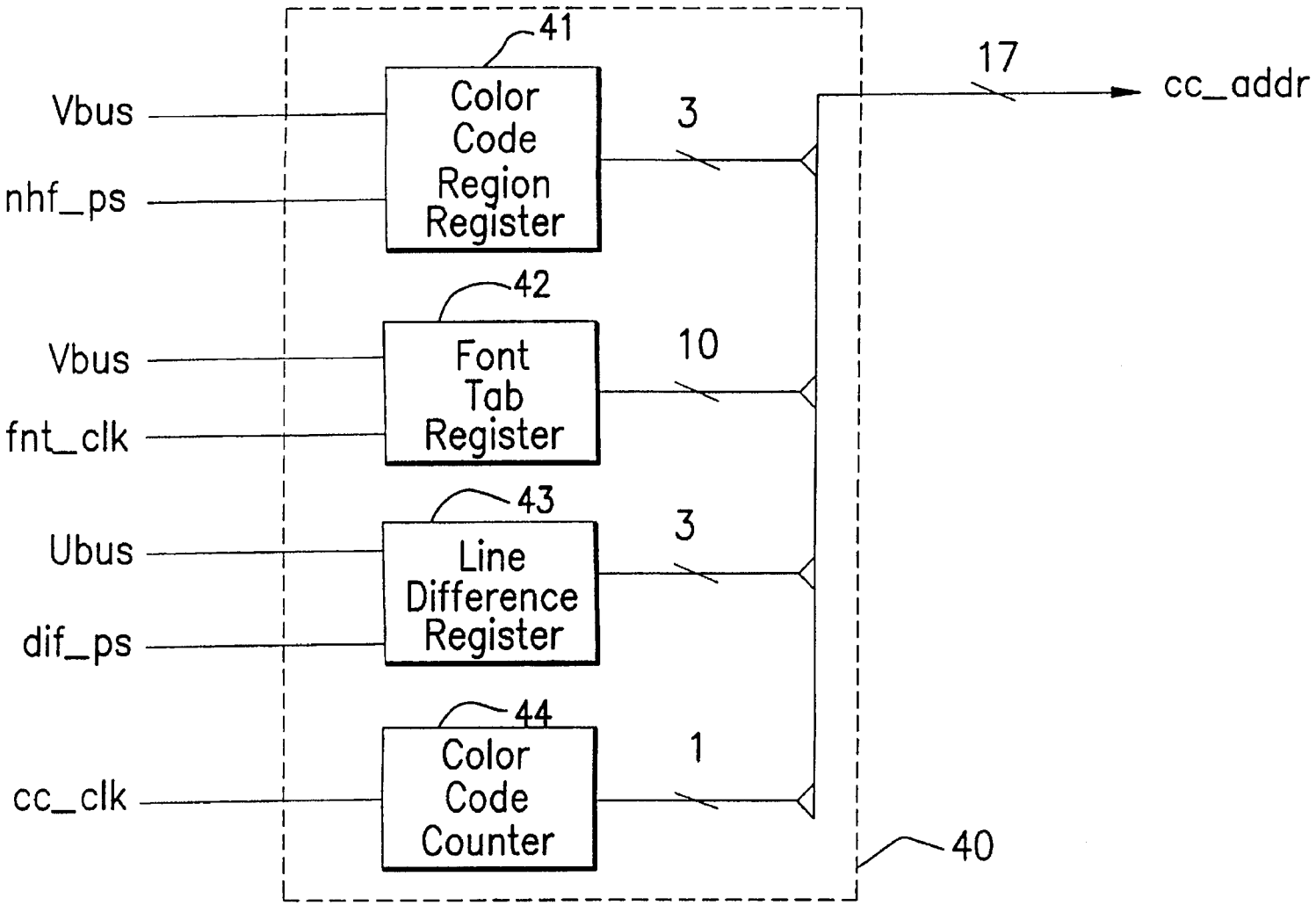
FIG. 4 is a block diagram of pixel color code address generator employed in the apparatus of FIG. 1.

Referring to FIG. 4, the color code address generator 40 is shown to comprise a color code region register 41, a font tab register 42, a line difference register 43, and a color code counter 44. The color code region register 41 is utilized to hold the color code region information sent by the video memory 50 via the video data bus Vbus. The storage of the color code region information in the register 41 is under the control of the horizontal font number writing signal nhf_ps issued by the status controller 10. The font tab register 42 is utilized to hold the font tab information sent also via the video data bus Vbus under the strobing of the font clock signal fnt_clk, also issued by the status controller 10. The line difference register 43 is utilized to hold the line difference information received via the bus libus under the strobing of the difference writing signal dif_ps issued by the CPU of the television-game machine system. The color code counter 44 is used to maintain a count of the number of times the color code information had been read. The outputs of the registers 41, 42 and 43, and the output of the counter 44, which in this described example are 3, 10, 3 and 1 bit, respectively, are combined to produce a 17-bit color code address cc_addr.

Figure 5:
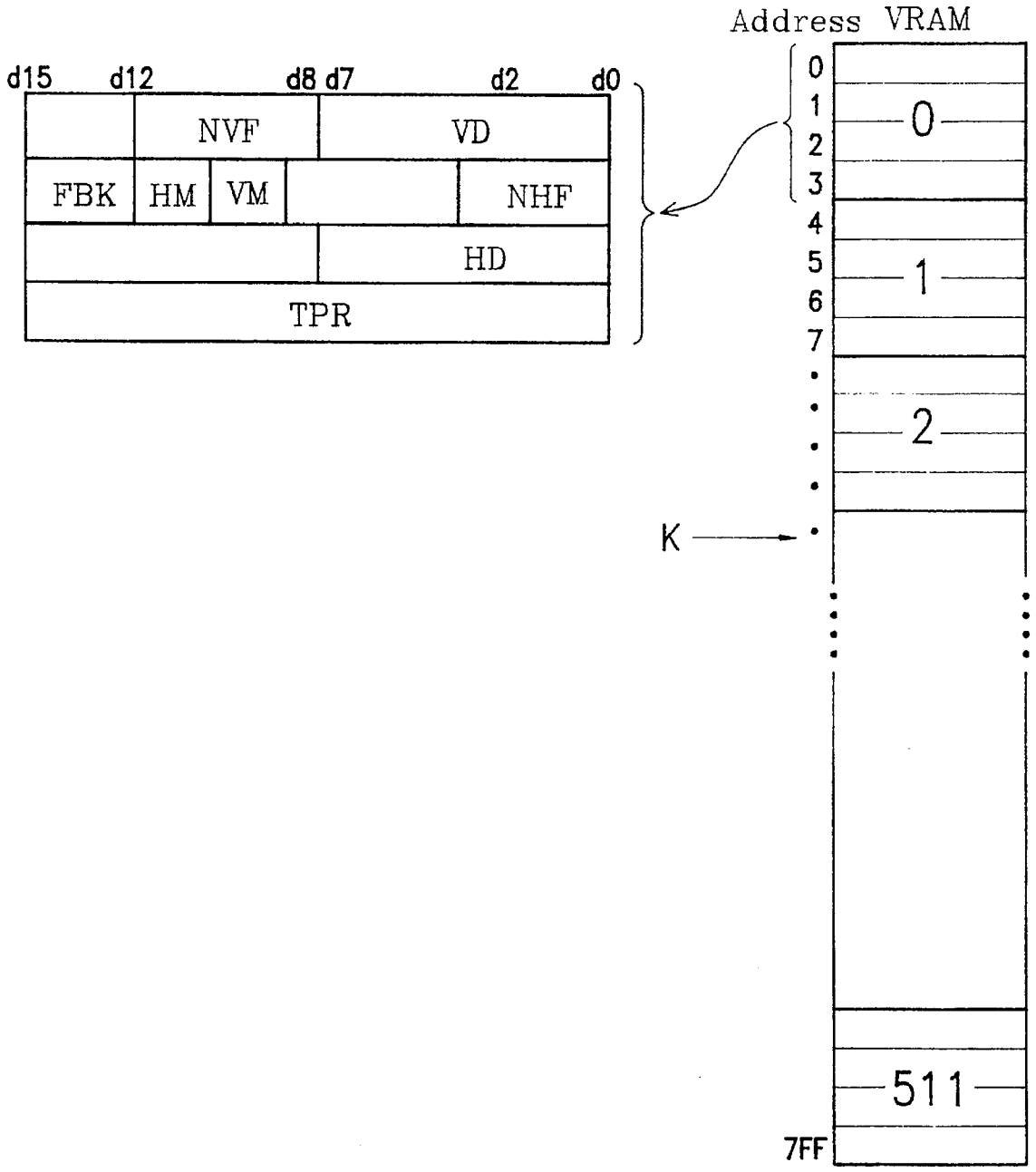
FIG. 5 is a diagram illustrating the storage of a parameter array in the video memory.
Figure 6:
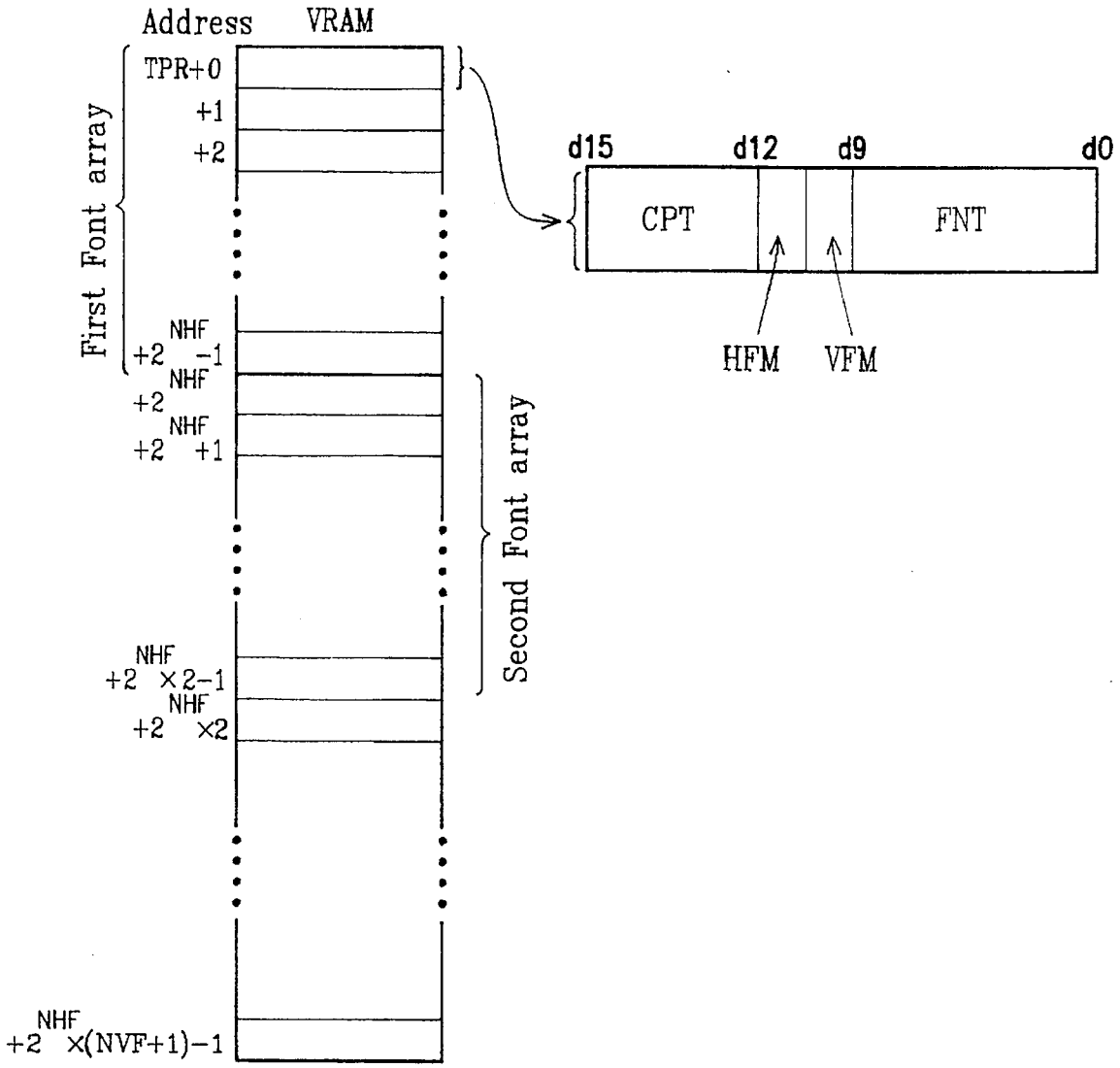
FIG. 6 is a diagram illustrating the storage of a tab array in the video memory.
Figure 7:
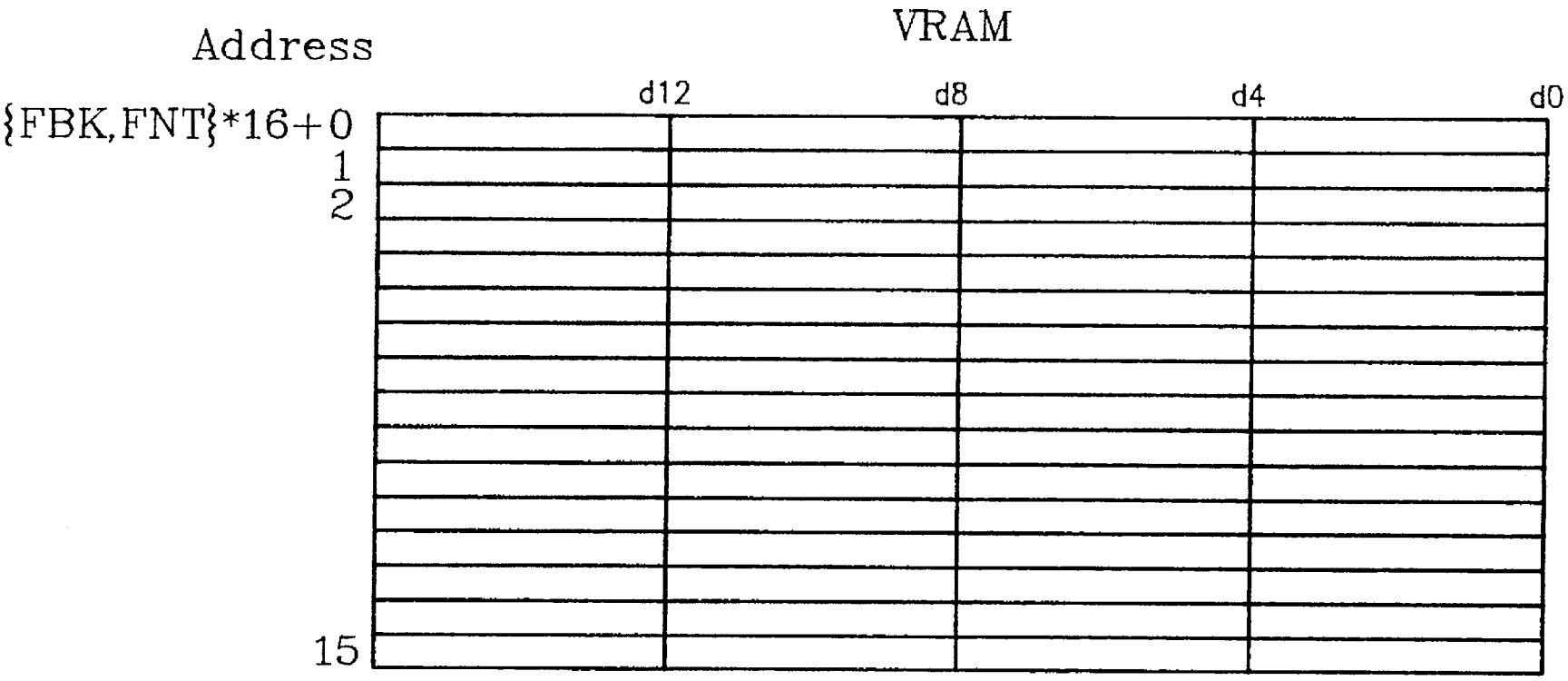
FIG. 7 is a diagram showing the storage of a color code array in the video memory.

Referring next to FIGS. 5–7, the storage of the parameter array, tab array, and color code array in the video memory VRAM 50 is shown, respectively. As shown in FIG. 5, the parameter array for each image of the motion video occupies four words (4×16 bits). The number of images in a motion video, which images are to be stored in the video memory 50 of FIG. 1 can be as many as 512. This is exemplified by the 512 arrays (0–511) occupying the 800 h (hexadecimal) positions of double bytes (d0–d15) shown in FIG. 5.

A parameter array can comprise the vertical font number NVF, the vertical position VD, color code region FBK, horizontal font number NHF, horizontal position HD, and tab array address TPR. The apparatus of the present invention searches for the color code based on the above indicated tab path and displays in accordance with the located color code. In addition, the parameter array can further comprise a horizontal reverse image parameter HM, which can be utilized to control an XOR (exclusive-or) logic circuit at the output stage of the horizontal font counter 34 shown in FIG. 3*a*, so as to generate a horizontally reversed image of the original video image. Similarly, the parameter array can further comprise a vertical reverse image parameter VM, in order to similarly control the generation of a vertically reversed image of the original video image.

Next, as shown in FIG. 6, each tab array consists of a 16-bit word (d0–d15) in the video memory VRAM 50. The tab array comprises a top position color code CPT, a horizontal reverse image parameter HFM, a vertical reverse image parameter VFM, and a font address FNT. As in the case of the parameter array in FIG. 5, the horizontal reverse image parameter HFM can be utilized to control the XOR logic circuit at the output stage of the color code counter 44 shown in FIG. 4 for generating a horizontally reversed image of the original video image. Likewise, the vertical reverse image parameter VFM can be utilized for generating a vertically reversed image of the original one. Thus, the tab array of each row of the font image can comprise $2^{NHF}$ tab addresses, wherein NHF represents the number of horizontal fonts.

Referring next to the color code array shown in FIG. 7, it can be seen that each of the color code information can comprise of 4 bits of data. Its locations in the array for storage is registered by the color code region FBK and the font address FNT.

Figure 8:
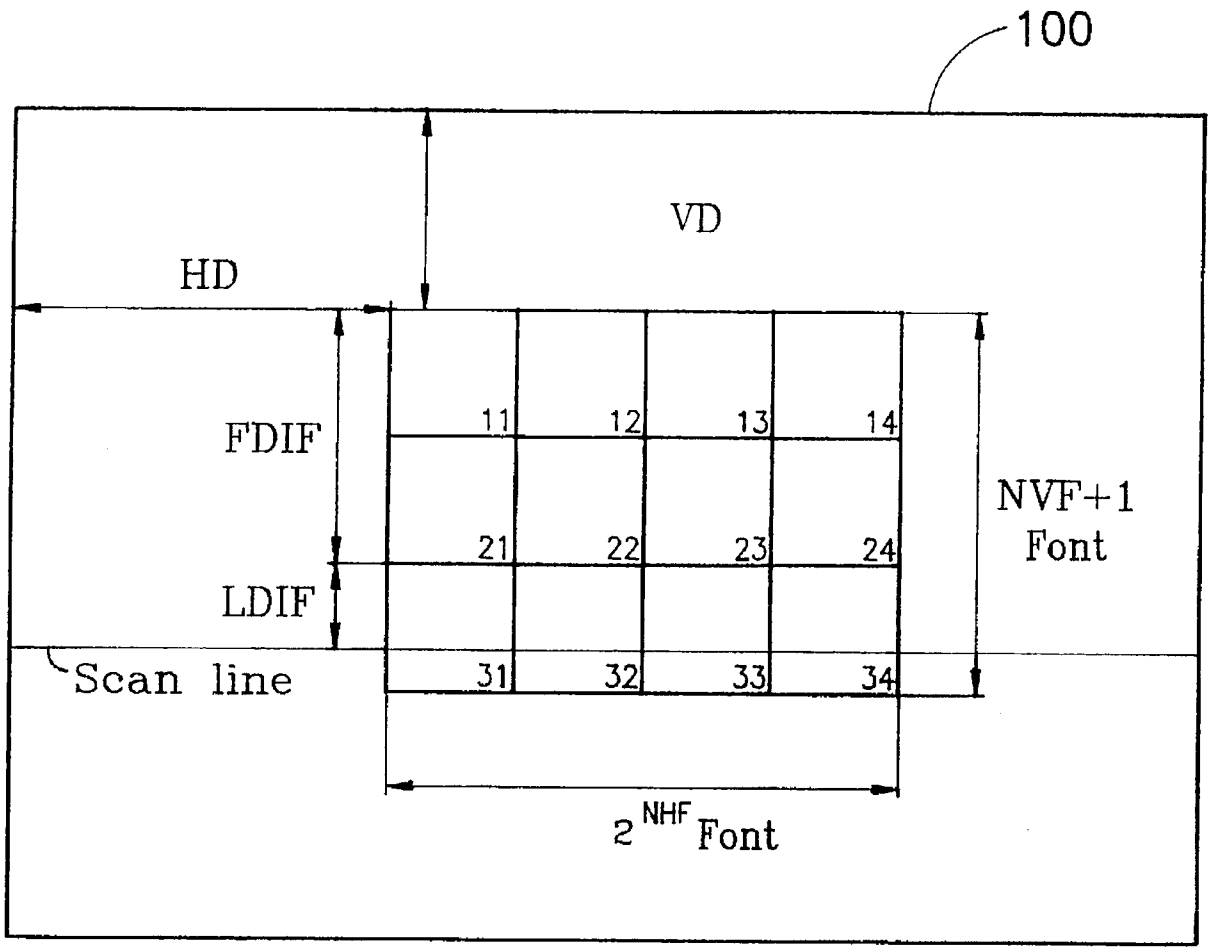
FIG. 8 is a diagram showing the line sequencing of an image within a scanning cycle for displaying on a screen.

Referring next to FIG. 8, an image as defined by the parameters is displayed in a portion of the screen 100. As shown, the image comprises $2^{NHF}$ by (NVF+1) fonts, and starts at the (HD, VD) location of the screen 100, wherein HD is the horizontal position from the left edge of the screen, and VD is the vertical position from the top edge of the screen. Thus, the current vertical scanning position can be calculated by adding the vertical position VD to the font difference FDIF and then adding again to the line difference LDIF. The current horizontal scanning position, on the other hand, can be calculated by adding the horizontal position HD to the horizontal font number NHF.

Figure 9A:
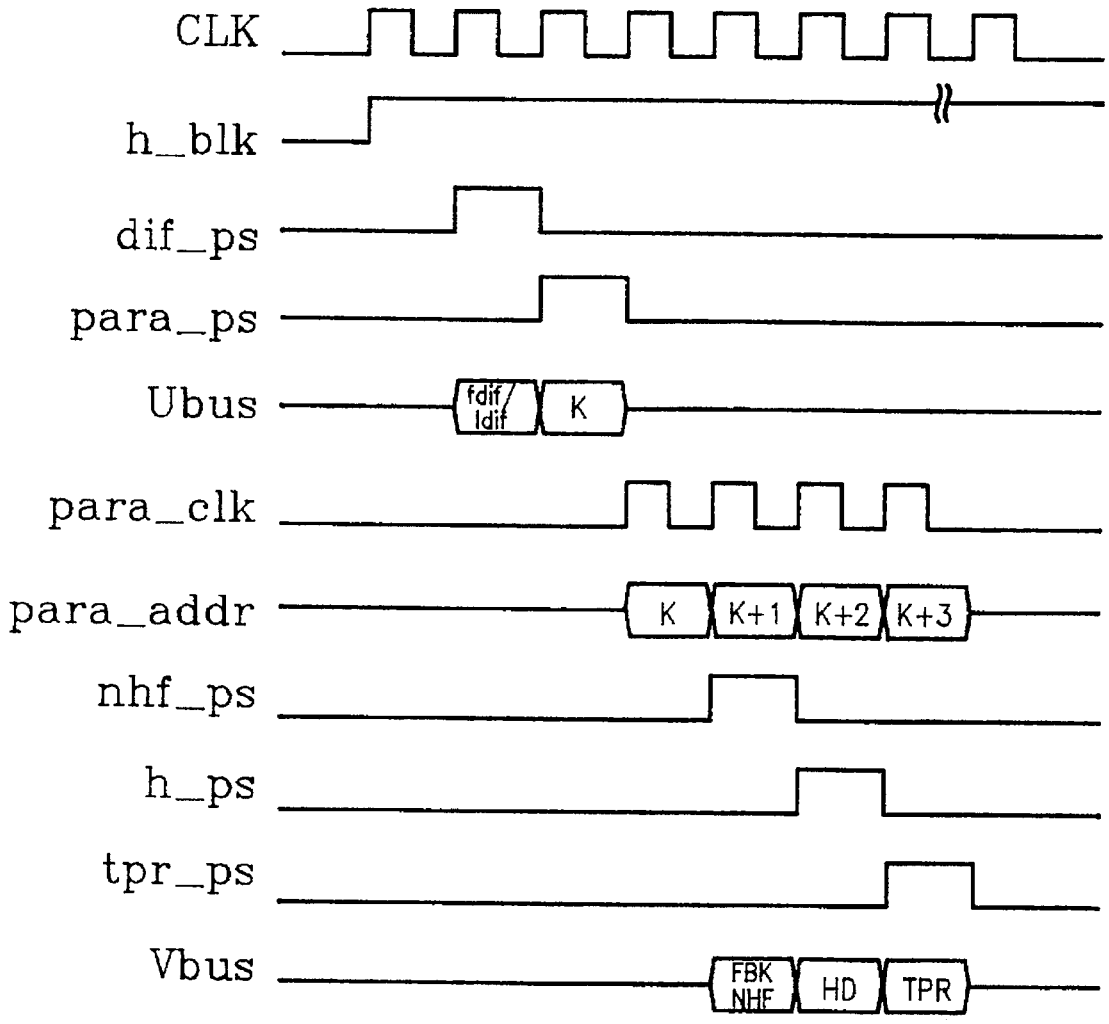
FIG. 9*a* is a time diagram showing the relative relationship of the scan line location signal and the horizontal blankout signal during an information writing cycle.
Figure 9B:
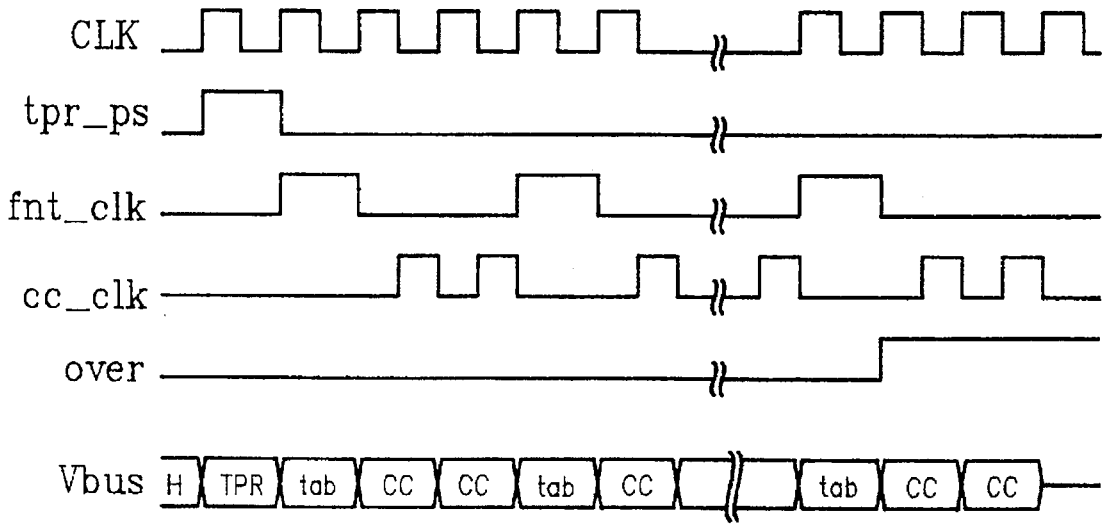
FIG. 9*b* is a time diagram showing the relative relationship of the color code clock pulse and the color code signal during a tab array address writing cycle.

The operation of the apparatus for displaying motion video image in accordance with the preferred embodiment of the present invention is described with reference to the time diagrams shown in FIGS. 9*a* and 9*b*. First, as is shown in the time diagram of FIG, 9*a*, the parameter writing signal para_ps, the difference writing signal dif_ps, and the information as sent via the bus Ubus, can be provided by the conventional CPU, and/or an ASIC (application-specific IC) of the system. The scan line position signal HPS and the horizontal blankout signal H_blk are provided by the exterior sources.

For example, if the video memory VRAM 50 shown in FIG. 1 has a total of 128K words of storage locations addressed by a 17-bit address ($2^{17}$=128K), then when the horizontal blankout signal H_blk initiates, the font difference information fdif, the line difference information ldif, and the parameters of the image are stored in the k memory location of the video memory via the bus Ubus under the control of the parameter writing signal para_ps and difference writing signal dif_ps. Refer to FIG. 5, as well as to FIGS. 2 and 9*a* concurrently. Address register 21 of the parameter address generator 20 receives the parameter address k (on Ubus) when strobed by the parameter writing signal para_ps, which subsequently triggers the status controller 10 to generate a sequence of four consecutive parameter writing signals para_ps, causing the counter 22 of the parameter address generator 20 to complete a cycle, producing a sequence of four addresses k, k+1, k+2 and k+3 for accessing the stored parameters.

The status controller 10 generates the nhf_ps, h_ps and tpr_ps writing signals at the appropriate instances to store the parameters in the respective registers. That is, at the instant of k+1, the horizontal font number NHF of the image is written into the horizontal font register 33 of FIG. 3*a*, at the instant of k+2, the horizontal position H of the image is written into the color code buffer address generator 60 of FIG. 1, and at the instant of k+3 in the time diagram, the tab array address tpr of the image is written into the tab array register 31 of the tab address generator of FIG. 3*a*. At the instant of k+1 on the time diagram, the color code region information fbk is also written into the color code region register 41 shown in FIG. 4.

At this moment, the image parameter retrieving process is complete, and the tab value in the tab array needs to be retrieved for accessing the color code information. Refer at this moment to FIG. 9*b*. The tab array register 31 shown in FIG. 3*a* stores the tab array address TPR supplied on the video data bus Vbus when strobed by the tab-parameter writing signal tpr_ps. As shown in FIG. 9*b*, the tab array address TPR is written and then calculated to produce the tab address tab_addr for output when the font clock signal fnt_clk is issued. Meanwhile, the status controller 10 is triggered to generate two consecutive color code clock pulses on signal cc_clk, which are supplied to the color code counter 44 shown in FIG. 4 for producing the color code address cc_addr after computational processing described above.

Figure 10:
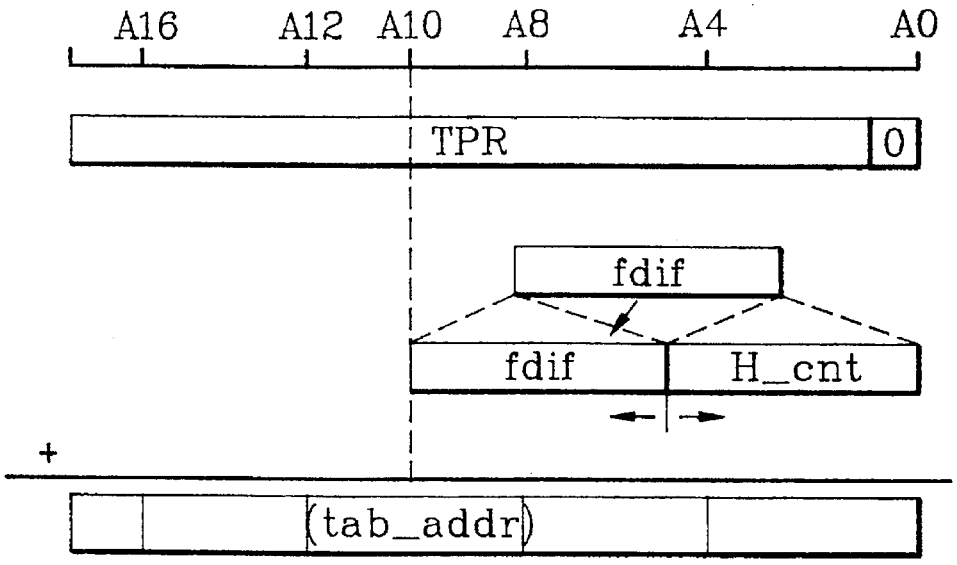
FIG. 10 is a diagram showing the generation of the tab address.

FIG. 10 illustrates how the tab address tab_addr is generated. Reference to FIG. 10 should be accompanied by FIGS. 3*a* and 3*b*. The initial tab array address tpr had been written into the tab array register 31, showing that font difference information fdif of the vertical font sequence had already been stored in the vertical font difference register 32 of FIG. 3*a*, and the horizontal font number NHF of the image had been stored in the horizontal font register 33.

When all of the image parameters are accessed successfully, the horizontal font counter 34 initiates its counting subsequently. The shift organizer 35 and adder 36 shown in FIG. 3*a* produce the array address as follows: (1) First, with reference to FIG. 3*b*, the shift organizer 35 shifts the font difference fdif (dif-num) leftwards a number NHF positions. In a preferred embodiment, fdif is a 5-bit number and NHF is a 0 to 5-bit integer. (2) Second, the output of the horizontal font counter 34 (fnt-num) is modularized, that is, it takes the NHF bits from its LSB (least significant bits) utilizing circuits 35*a*, 35*b*, 35*c* and 35*d*. For example, circuit 35*b* may comprise a series of AND gates, circuit 35*c* may comprise a series of OR gates, and circuit 35*d* may be a decoder for decoding NHF. (3) Third, the results of the previous two steps are combined together to produce tab_hum. (4) Fourth, the adder 36 adds the combined result of step 3 to the tab array address to produce the tab address tab_addr. (5) Fifth, the clock signals for the horizontal font counter 34 are then generated by the status controller 10. Whenever the counter 34 accumulates its counting value to a number equal to the number stored in the horizontal font register 33, then the horizontal font counting is complete. At this moment, an overflow signal "over" is produced by horizontal font counter 34 which is supplied to the status controller 10 so as to stop the accessing operation until the next parameter information is written under the control of a next parameter writing signal para_ps.

Figure 11:
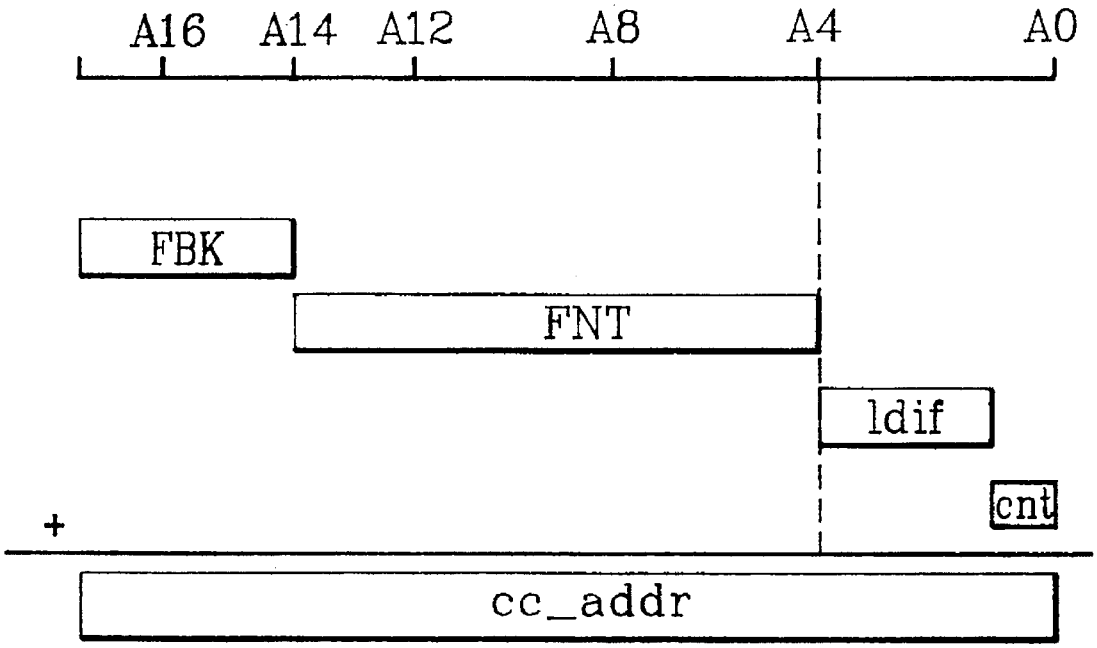
FIG. 11 is a diagram showing the generation of the color code address.

Refer now to FIG. 11. FIG. 11 is a diagram showing the generation of the color code address. When the tab address is retrieved as described above, it is written into the font tab register 42 shown in FIG. 4. When the color code array (FIG. 7) is to be accessed, due to the fact that the length of the color code, as well as the size of the font, are fixed, therefore, the calculation of the color code address cc_addr will be easier, as expressed in the following equation:

$$cc_addr = FBK \times 2^{14} + FNT \times 2^{4} + ldif \times 2^{1} + cnt$$

The color code region FBK, the font address, the line difference ldif, as well as the counter information output by color code register 44 are cascaded together for generating the color code address cc_addr. Among which, the color code counter 44 has a one-bit output. If the color code information is four bits wide, and the video data bus Vbus is 16-bits wide, then two read accessing cycles will be able to complete the retrieving of the color code of a font of the horizontal line. After that, status controller 10 produces another font clock signal fnt_clk which allows the tab address generator 30 to retrieve a further tab value, the process being repeated until the horizontal font counter 34 overflows and issues an "over" signal.

Although the present invention of the method and apparatus for displaying a motion video image has been described based on the exemplified preferred embodiment, it is, however, apparent to persons skilled in this art that the present invention is not limited thereto. Modifications to the exemplified embodiment can be made without departing from the scope of the disclosed invention which is defined in the following claims.

What is claimed is:

1. A motion video image displaying apparatus, comprising:

status control means for generating timing control signals corresponding to a video image;

address generator means for generating a plurality of address data in accordance with said timing control signals, said address generator means including parameter address generating means for generating parameter address data, tab address generating means for generating tab address data and color code address generating means for generating color code address data; and video memory means for storing selected ones of said plurality of address data and for supplying video data as an output.

2. The motion video image displaying apparatus of claim 1, further comprising buffer means for selectively buffering said parameter address data, said tab address data and said color code address data, and wherein said video memory means stores said address data selectively buffered by said buffer means.

3. A method for displaying motion video images, comprising the steps of:

generating a plurality of timing control signals;

generating a parameter address based on said timing control signals and information issued by a central processing unit;

generating a tab address and an overflow signal from said timing control signals;

generating a color code address based on said timing control signals, information read in accordance with said tab address, and video information;

buffering said parameter address, said tab address, and said color code address, and selectively outputting at least one of said buffered addresses; and storing and outputting video information and video parameters based on said buffered addresses.

4. The method for displaying motion video images of claim 3, wherein the pixel length and width of an image font in said video information is obtained by raising 2 to selected powers.

5. The method for displaying motion video images of claim 4, wherein the width of an image corresponding to said video information comprises a number of fonts obtained by raising 2 to a selected power.

6. The method for displaying motion video images of claim 5, wherein the color code information of a motion video image is stored as separated image fonts having a fixed size.

7. The method for displaying motion video images of claim 6, wherein a tab array determines the storage address for each of said fonts.

8. The method for displaying motion video images of claim 3, further comprising the steps of generating a buffer address for buffering video information based on said timing control signals, buffering said video information at an address corresponding to said buffer address, and outputting said video information in sequence when a scanning of said video image begins.

9. The method for displaying motion video images of claim 8, further comprising the step of converting the video information into a television signal.

10. The method for displaying motion video images of claim 3, wherein the step of generating a parameter address is performed by receiving and storing address data supplied by said central processing unit, maintaining a count of the number of times a parameter writing clock signal in said timing control signals is received, and combining said count with said address data to produce said parameter address.

11. The method for displaying motion video images of claim 3, wherein the step of generating a tab address and an overflow signal is performed by storing an externally supplied tab array address, storing a vertical font number supplied by said central processing unit, storing an externally supplied horizontal font number, maintaining a count of the number of horizontal fonts, generating an overflow signal when said count exceeds a range of a displayed video image, shifting said vertical font number in accordance with the horizontal font number, and adding said tab array address to said count for producing said tab address.

12. The method for displaying motion video images of claim 3, wherein the step of generating a color code address is performed by storing font tab information of a selected length, storing line difference information for the same line of a font, maintaining a color code count of the number of times color code information is read, and generating said color code address by combining said font tab information, said line difference information and said color code count.

13. The method for displaying motion video images of claim 3, further comprising the steps of storing color code region information and combining said color code region information in said color code address.

14. A method for displaying motion video images, comprising the steps of:

generating timing control signals corresponding to a video image;

generating a plurality of address data in accordance with said timing control signals, said step of generating a plurality of address data including the steps of generating parameter address data, generating tab address data and generating color code address data; and storing selected ones of said plurality of address data and supplying video data as an output.

15. The method for displaying motion video images of claim 14, further comprising the steps of selectively buffering said parameter address data, said tab address data and said color code address data.

16. A motion video image displaying apparatus, comprising:

a status controller for generating a plurality of timing control signals;

a parameter address generator for generating a parameter address based on said timing control signals and data supplied by a central processing unit;

a tab address generator for generating a tab address based on said timing control signals and for producing and supplying an overflow signal to said status controller;

a color code address generator for generating a color code address based on said timing control signals, said tab address and video information;

buffering means for buffering said parameter address, said tab address and said color code address, said buffering means being controlled by said status controller to selectively output one of said buffered addresses; and video memory means for storing and outputting video information and video parameters based on said parameter address, said tab address and said color code address output by said buffering means.

17. The motion video image displaying apparatus of claim 16, further comprising a color code buffer address generator for generating a buffer address for buffering video information based on said timing control signals generated by said status controller, and a color code buffer for buffering said video information output from said video memory in an address corresponding to said buffer address, said color code buffer outputting said video information in sequence when a scanning of a display screen of a displaying apparatus begins.

18. The motion video image displaying apparatus of claim 17, further comprising a television interface for receiving said video information output by said color code buffer and for converting said video information into television signals.

19. The motion video image displaying apparatus of claim 18, wherein said television interface includes a color palette for converting said video information output by said color code buffer into a converted video signal, and a television signal generator for generating said television signals from said converted video signal.

20. The motion video image displaying apparatus of claim 16, wherein said parameter address generator includes an address register for receiving and storing address data supplied by said central processing unit, and a counter for maintaining a count of the number of times a parameter writing clock signal is received from said status controller, said parameter address generator combining said count with said address data stored in said address register to produce said parameter address.

21. The motion video image displaying apparatus of claim 16, wherein said tab address generator includes a tab address register for storing an externally supplied tab array address, a vertical font difference register for storing a vertical font number supplied by said central processing unit, a horizontal font register for storing an externally supplied horizontal font number, a horizontal font counter for maintaining a count of the number of horizontal fonts and for generating an overflow signal when said count exceeds a range of a displayed video image, a shift organizer for shifting said vertical font number stored in said vertical font register in accordance with the horizontal font number stored in said horizontal font register, an adder for adding said tab array address to said count maintained by said horizontal font counter and for adding again to the output of said shift organizer for producing said tab address.

22. The motion video image displaying apparatus of claim 16, wherein said color code address generator includes a font tab register for storing font tab information of a selected length, a line difference register for storing line difference information for the same line of a font, a color code counter for maintaining a color code count of the number of times color code information is read, said color code address generator generating said color code address by combining said font tab information stored in said font tab register, said line difference information stored in said line difference register and said color code count maintained by said color code counter.

23. The motion video image displaying apparatus of claim 16, further comprising a color code region register for storing color code region information, said color code region information being combined in said color code address.

24. The motion video image displaying apparatus of claim 16, further comprising a multiplexer for multiplexing the output of said parameter address generator, the output of said tab address generator, and the output of said color code address generator to provide a multiplexed output.

* * * * *